US010030653B2

(12) United States Patent
Kienzle

(10) Patent No.: US 10,030,653 B2
(45) Date of Patent: Jul. 24, 2018

(54) SCREW COMPRESSOR HAVING A VOLUME RATIO BEING ADJUSTED BY END FACES EXTENDING ALONG FROM A LOW-PRESSURE SIDE END WALL TO DISCHARGE EDGES OF A SLIDER

(71) Applicant: Dominic Kienzle, Renningen (DE)

(72) Inventor: Dominic Kienzle, Renningen (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 504 days.

(21) Appl. No.: 14/151,404

(22) Filed: Jan. 9, 2014

(65) Prior Publication Data

US 2014/0127067 A1 May 8, 2014

Related U.S. Application Data

(63) Continuation of application No. PCT/EP2012/061356, filed on Jun. 14, 2012.

(30) Foreign Application Priority Data

Jul. 11, 2011 (DE) ..... 10 2011 051 730

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/16*** | (2006.01) |
| ***F01C 20/12*** | (2006.01) |

(Continued)

(52) U.S. Cl.

CPC ..... *F04C 2/16* (2013.01); *F01C 20/10* (2013.01); *F01C 20/12* (2013.01); *F04C 18/16* (2013.01); *F04C 28/12* (2013.01); *F04C 28/125* (2013.01); *F04C 29/0007* (2013.01)

(58) Field of Classification Search

CPC ..... F04C 28/12; F04C 28/125; F04C 14/26; F04C 18/16; F02D 41/0007; F01C 11/008;

(Continued)

(56) References Cited

U.S. PATENT DOCUMENTS

| | | |
|---|---|---|
| 4,042,310 A | 8/1977 | Schibbye et al. |
| 4,611,976 A | 9/1986 | Schibbye et al. |

(Continued)

FOREIGN PATENT DOCUMENTS

| | | |
|---|---|---|
| DE | 2 210 847 | 3/1972 |
| DE | 32 21 849 A1 | 12/1983 |

(Continued)

*Primary Examiner* — Theresa Trieu

(74) *Attorney, Agent, or Firm* — Reinhart Boerner Van Deuren P.C.

(57) ABSTRACT

A screw compressor housing having screw rotor bores, screw rotors, a drive for the screw rotors, and a slider in a slider receptacle for adjusting a volume ratio of the screw compressor and which extends in a direction towards the high-pressure outlet in a guide trough of the slider receptacle that is open towards the screw rotor bores and which is capable of being positioned in a first position and a second position, wherein the volume ratio of the screw compressor is greater in one of the positions than in the other of the positions, the slider connected to a first cylinder element and cooperates with a second cylinder element, the cylinder elements being at least partially arranged in the insertion space and arranged following the slider in the displacement direction thereof on a side of the slider that is opposite the high-pressure outlet.

23 Claims, 14 Drawing Sheets

(51) Int. Cl.

| | |
|---|---|
| ***F01C 20/10*** | (2006.01) |
| ***F04C 18/16*** | (2006.01) |
| ***F04C 28/12*** | (2006.01) |
| ***F04C 29/00*** | (2006.01) |

(58) Field of Classification Search
CPC ..... F01C 20/10; F01C 20/12; F02B 33/38; F02B 33/44; Y02T 10/144
USPC ..... 418/201.1, 201.2, 159; 417/309, 310; 123/564, 559.1
See application file for complete search history.

(56) References Cited

U.S. PATENT DOCUMENTS

| | | | | |
|---|---|---|---|---|
| 2004/0050081 | A1* | 3/2004 | Tsuboi | 62/197 |
| 2005/0226758 | A1* | 10/2005 | Hossner | 418/201.1 |
| 2006/0008375 | A1 | 1/2006 | Hasegawa | |
| 2007/0086908 | A1* | 4/2007 | Faccio et al. | 418/201.1 |
| 2012/0003113 | A1 | 1/2012 | Shikano et al. | |

FOREIGN PATENT DOCUMENTS

| | | | | |
|---|---|---|---|---|
| DE | 199 16 983 | A1 | 10/2000 | |
| DE | 20 2008 013 702 | U1 | 12/2008 | |
| DE | 10 2007 060 481 | A1 | 6/2009 | |
| DE | 10 2011 055 350 | A1 | 5/2012 | |
| EP | 1072796 | A2 * | 1/2001 | F04C 18/16 |
| GB | 2 119 445 | A | 11/1983 | |
| GB | 2 122 687 | A | 1/1984 | |
| JP | 04-342891 | A | 11/1992 | |
| JP | 2008-143461 | A | 6/2008 | |
| WO | WO 93/18307 | A1 | 9/1993 | |
| WO | WO 2010/106787 | A1 | 9/2010 | |

* cited by examiner

SCREW COMPRESSOR HAVING A VOLUME RATIO BEING ADJUSTED BY END FACES EXTENDING ALONG FROM A LOW-PRESSURE SIDE END WALL TO DISCHARGE EDGES OF A SLIDER

CROSS-REFERENCE TO RELATED PATENT APPLICATIONS

This application is a continuation of International application No. PCT/EP2012/061356 filed on Jun. 14, 2012.

This patent application claims the benefit of International application No. PCT/EP2012/061356 of Jun. 14, 2012 and German application No. 10 2011 051 730.8 of Jul. 11, 2011, the teachings and disclosure of which are hereby incorporated in their entirety by reference thereto.

BACKGROUND OF THE INVENTION

The invention relates to a screw compressor comprising a screw compressor housing having a screw rotor housing, screw rotor bores arranged in the screw rotor housing, screw rotors arranged in the screw rotor bores and mounted in the screw rotor housing for rotation about rotational axes, a drive for the screw rotors, and a slider which is guided for displacement in a slider receptacle in the screw rotor housing and is, in areas, in adjacent relation to the screw rotors with end faces, for adjusting a volume ratio of the screw compressor and which, starting from an insertion space of the slider receptacle, extends in a direction towards the high-pressure outlet in a guide trough of the slider receptacle that is open towards the screw rotor bores and which is capable of being positioned in a first position and a second position, wherein the volume ratio of the screw compressor is greater in one of the positions than in the other of the positions.

Screw compressors of this type are known for example from DE 199 16 983 or DE 20 2008 013 702.

A problem with these known solutions is that they require a very large amount of space for installation.

Hence, the object underlying the invention is to improve a screw compressor of the generic kind such that it requires as small an installation space as possible for actuation of the slider.

SUMMARY OF THE INVENTION

In accordance with the invention, this object is accomplished in a screw compressor of the type described at the outset by the slider being connected to a first cylinder element which is at least partially arranged in the insertion space and cooperates with a second cylinder element which is at least partially arranged in the insertion space and by the cylinder elements being arranged following the slider in the displacement direction thereof on a side of the slider that is opposite the high-pressure outlet.

The advantage of the solution in accordance with the invention is that it affords the possibility of arranging the cylinder elements in a space-efficient manner in the screw compressor housing.

It is particularly advantageous for the insertion space to be configured for receiving the first cylinder element both in the first position and in the second position.

Furthermore, provision is preferably also made for the insertion space to be configured for receiving the second cylinder element.

The second cylinder element may be a separate element arranged in the insertion space or it may be an element formed by the insertion space itself.

No details have been provided yet as to the arrangement and configuration of the insertion space.

Thus, an advantageous solution provides for the insertion space to be arranged free of overlap relative to the screw rotor bores, i.e. for the insertion space and the screw rotor bores to have no spatial overlap between them so that the insertion space is configured as separate from the screw rotor bores.

Likewise, no details have been provided yet as to the arrangement of the insertion space relative to the guide trough of the slider receptacle. In principle, the insertion space could be arranged at a distance away from the guide trough.

It is, however, particularly advantageous for the insertion space to immediately adjoin the guide trough.

In order to arrange the insertion space as close as possible to the screw rotor bores and the screw rotors, provision is preferably made for the insertion space to be arranged laterally beside a low-pressure side bearing unit for the screw rotors in a radial direction relative to the rotational axes of the screw rotors.

In the previous description of the solution in accordance with the invention, it has not been defined exactly how far the insertion space should extend in the screw compressor housing.

By way of example, the insertion space could extend both in the screw rotor housing and into the motor housing.

However, a particularly simple and space-efficient solution provides for the insertion space to extend in the screw rotor housing and preferably not to extend into the motor housing.

No details have been provided yet as to the cross-section of the insertion space.

Thus, a particularly advantageous solution provides for the insertion space to have a cross-sectional contour that extends transversely to the displacement direction and is at least large enough to receive the slider and the first cylinder element. In this way, the slider and the first cylinder element can be conjointly moved into the insertion space so that the slider and the first cylinder element can be designed to make a compact configuration.

It is advantageous for the cross-sectional contour of the insertion space to be adapted to the cross-sectional contour of the first cylinder element, in which case the cross-sectional contour of the first cylinder element is larger than the cross-sectional contour of the slider so that the slider can also enter the insertion space smoothly.

In order to guide the slider as securely as possible, provision is preferably made for the insertion space to have a wall surface portion which forms slider guide surfaces guiding the slider transversely to the displacement direction in the insertion space. This makes it possible for the slider to be reliably guided both in the guide trough and in the insertion space.

No details have been provided yet as to the configuration of the first cylinder element in relation to the slider.

A solution geared to render the construction particularly compact provides for the first cylinder element to be fixedly connected to the slider.

A particularly advantageous solution is one in which the first cylinder element is formed integrally in one piece on the slider so that a construction results that is optimally compact.

A compact solution, in particular in terms of construction, provides for the insertion space to form the second cylinder element.

For example, the insertion space is configured such that the insertion space itself is located in a cylinder housing and receives a piston body.

Such a solution is particularly compact.

No details have been provided yet as to the cooperation of the cylinder elements for moving the slider.

In this connection, an advantageous solution provides for the first cylinder element and the second cylinder element to enclose a cylinder volume which has applied thereto either a medium compressed to high pressure or a medium at low pressure, in particular a medium intended for compression, so that this provides a simple possibility of control by the application of high pressure or low pressure to the cylinder volume.

Alternatively or in addition to the previously described embodiments, a particularly advantageous embodiment provides for low-pressure pockets to be provided on a side of the slider that is opposite the end faces thereof and is located in the guide trough, and said low-pressure pockets may be provided either in the slider or in the guide trough of the screw rotor housing.

Such low-pressure pockets are advantageous in that they provide the possibility of ensuring that the slider will not lift off the guide trough and move transversely to the displacement direction in a direction towards the screw rotors, thereby pushing against the screw rotors with its end faces.

A variety of ways exist by which the low-pressure pockets can be maintained at low pressure.

Thus, a particularly advantageous solution provides for the low-pressure pockets to be maintained at low pressure via an unloading channel that leads to the low-pressure inlet and extends either through the slider or through the screw rotor housing.

Such an unloading channel is preferably a channel which extends transversely across the slider from the low-pressure pockets to a low-pressure side of the slider and terminates in a mouth opening into said low-pressure side so that low pressure can always be maintained in the low-pressure pockets via said unloading channel.

It is in particular provided for the mouth opening to be arranged for example on a ridge of the slider formed by the end faces thereof.

In an advantageous exemplary embodiment it is preferably provided for the screw rotor housing to have therein an injection channel for lubricant that opens for example into one of the rotor bores and by which lubricant is in particular capable of being supplied to a compression chamber formed by the screw rotor, preferably to a first compression chamber being formed, with said supply of lubricant being realized in particular independently of the slider's positions.

This allows for convenient cooling and sealing of the screw rotors to be implemented.

At high pressure ratio and pressure differential conditions between low-pressure inlet and high-pressure outlet, increased leakage occurs between the individual rotor chambers, thereby generating more waste heat.

Likewise, more heat of compression is generated at high pressure ratio and pressure differential conditions than at low pressure ratio and pressure differential conditions.

It is therefore advantageous to inject more lubricant at higher pressure ratio and pressure differential conditions than at low pressure ratio and pressure differential conditions in order thereby to dissipate the waste heat generated.

The amount of lubricant injected may for example vary depending on the volume ratio and/or a pressure difference and/or the rotational speed.

Moreover, in a further advantageous embodiment provision is made for the slider to be provided with an injection opening for lubricant that faces towards the screw rotors so that lubricant can be supplied to the screw rotors via the slider, at least in the first position thereof, which corresponds to a high volume ratio.

By way of example, provision is made for the injection opening to be in communication with an injection channel which is provided in the slider and is capable of being supplied with lubricant from the screw rotor housing via a supply opening.

Preferably, the amount of lubricant that is capable of being supplied via the slider is at least the same amount, preferably more than one-and-a-half times the amount, more preferably more than twice the amount of lubricant that is supplied via the screw rotor housing at all positions of the slider.

Also the amount of lubricant that is supplied via the slider can be varied depending on the volume ratio and/or the pressure difference and/or the rotational speed.

The screw compressor constructed in accordance with the invention may be provided with a drive that operates at one or more rotational speeds determined in a defined manner and which drives the screw compressor.

It is particularly advantageous for the drive to be configured with variable speed capability, in particular with infinitely variable speed capability over significant ranges of rotational speed, wherein the variable speed drive is advantageously realized using an inverter.

Further features and advantages of the invention are the subject of the following description and drawings of a number of exemplary embodiments.

DETAILED DESCRIPTION OF THE INVENTION

Figure 1:
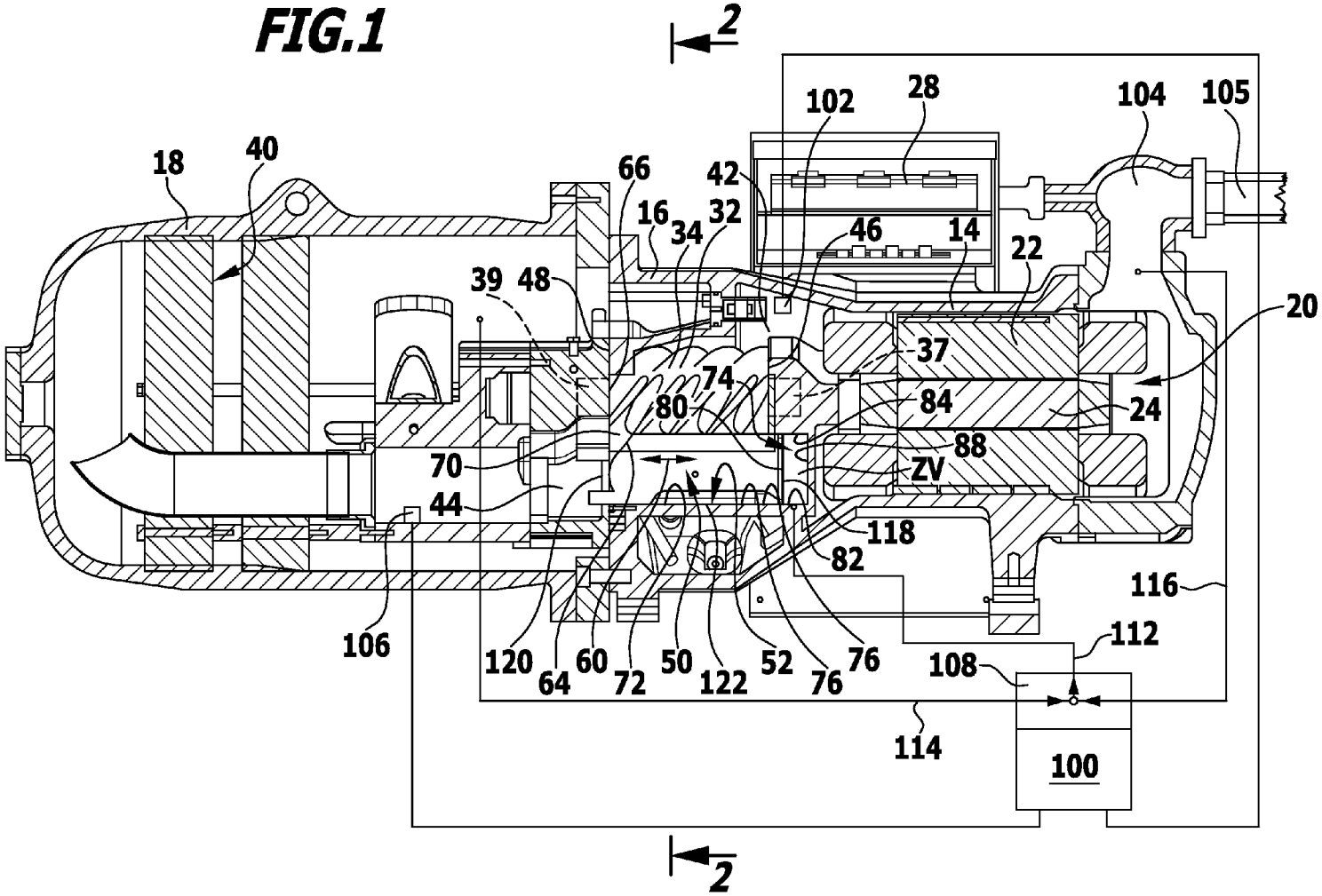
FIG. 1 is a longitudinal section through a first exemplary embodiment of a screw compressor constructed in accordance with the invention, shown in the first position.
Figure 2:
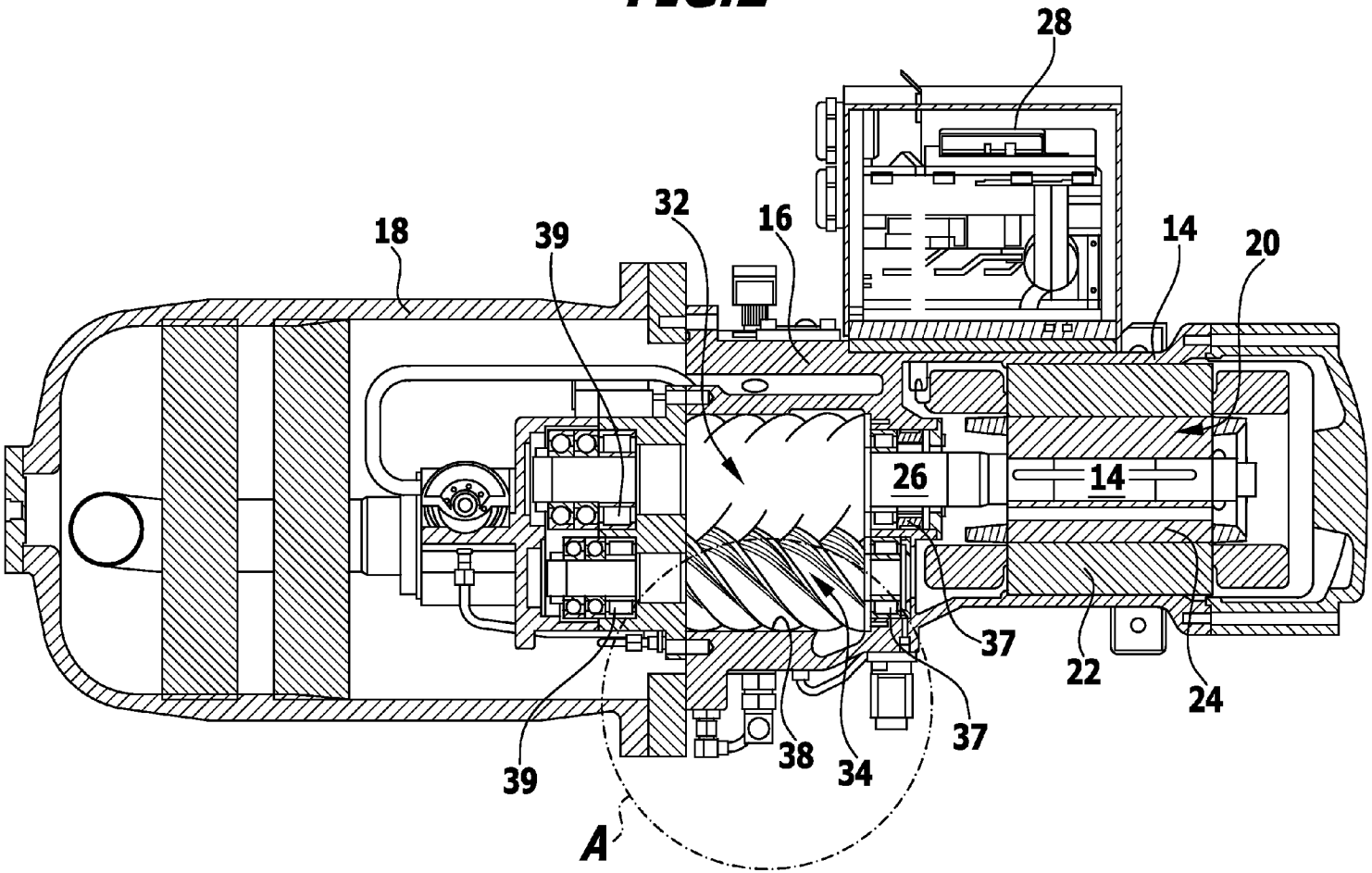
FIG. 2 is a longitudinal section similar to FIG. 1 but in a sectional plane that is rotated with respect to that of FIG. 1.
Figure 3:
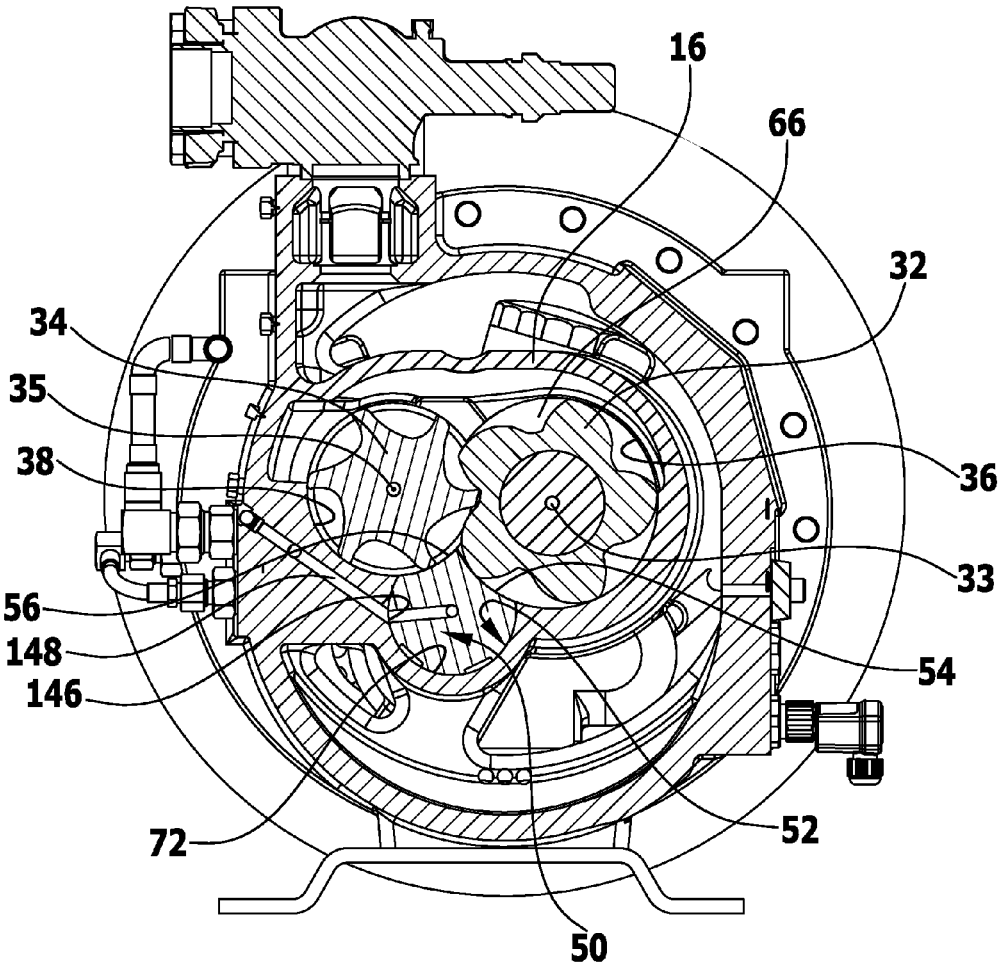
FIG. 3 is a section taken along the line 2-2 in FIG. 1.

An exemplary embodiment of a screw compressor, generally indicated at 10, comprises a screw compressor housing designated at 12 and comprising a motor housing 14, a screw rotor housing 16 and for example a high-pressure housing 18 (FIGS. 1 to 5).

Provided in the motor housing 14 is a drive motor generally indicated at 20 and comprising a stator 22 and a rotor 24, wherein said rotor 24 drives, via a drive shaft 26 and with use of variable-speed control for example by inverter 28, one out of two screw rotors 32 and 34 which are arranged in screw rotor bores 36, 38 in the screw rotor housing 16 and are mounted in a low-pressure side bearing unit 37 and in a high-pressure side bearing unit 39 and intermesh, thereby compressing a medium to be compressed which is supplied via a low-pressure inlet 42 so that the medium being compressed exits again via a high-pressure outlet 44 of the screw rotor housing 16 and then, from the high-pressure outlet 44, enters the high-pressure housing 18 in which is arranged for example a lubricant separating device 40 where lubricant and medium being compressed that has been placed under high pressure are separated before the latter exits the high-pressure housing 18.

Provided in the screw rotor housing 16 is a slider, generally indicated at 50, which is guided in a slider receptacle 52 for movement in a displacement direction 60 parallel to the rotational axes 33 and 35 of the screw rotors 32 and 34 respectively and, as illustrated in FIGS. 1 to 13, has end faces 54 and 56 which are adjacent to the screw rotors 32 and 34 and complement the screw rotor bores 36 and 38, said end faces 54 and 56 forming, in the area in which they are adjacent to the screw rotors 32 and 34, a boundary of the compression chambers formed by the screw rotors 32 and 34.

The end faces 54 and 56 extend along the slider 50 from a low-pressure side end wall 58 which is in contacting relationship with the slider receptacle 52 on all sides to discharge edges 62 and 64 whose position along the screw rotors 32 and 34, in particular whose distance from a high-pressure side end wall 66 of the screw rotor bores 36 and 38, enables a high-pressure side outlet window 70 to be determined which extends between the end wall 66 and the discharge edges 62 and 64, wherein a distance of the discharge edges 62, 64 from the low-pressure inlet 42 determines a volume ratio of the screw compressor. The volume ratio determines the volume of the first closed compression chamber between the screw rotors 32 and 34 to the volume of the last closed compression chamber of the screw rotors 32, 34, wherein the volume of the last closed compression chamber is determined by the position of the discharge edges 62 and 64 at which the last closed compression chamber always becomes exposed to the high-pressure outlet 44, and hence also by the size of the outlet window 70.

Figure 4:
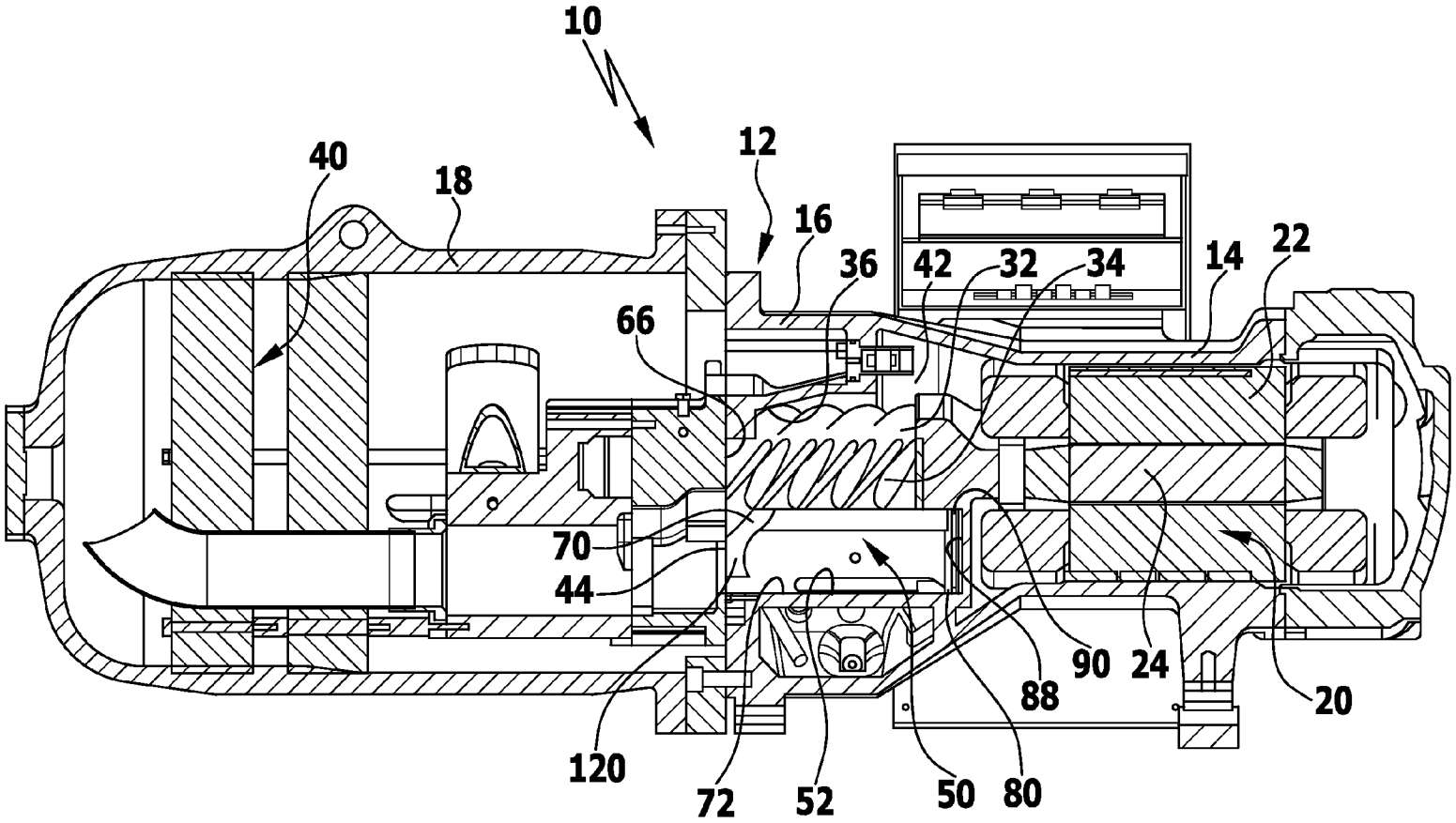
FIG. 4 is a section similar to FIG. 1, taken through the first exemplary embodiment with the slider in the second position.
Figure 5:
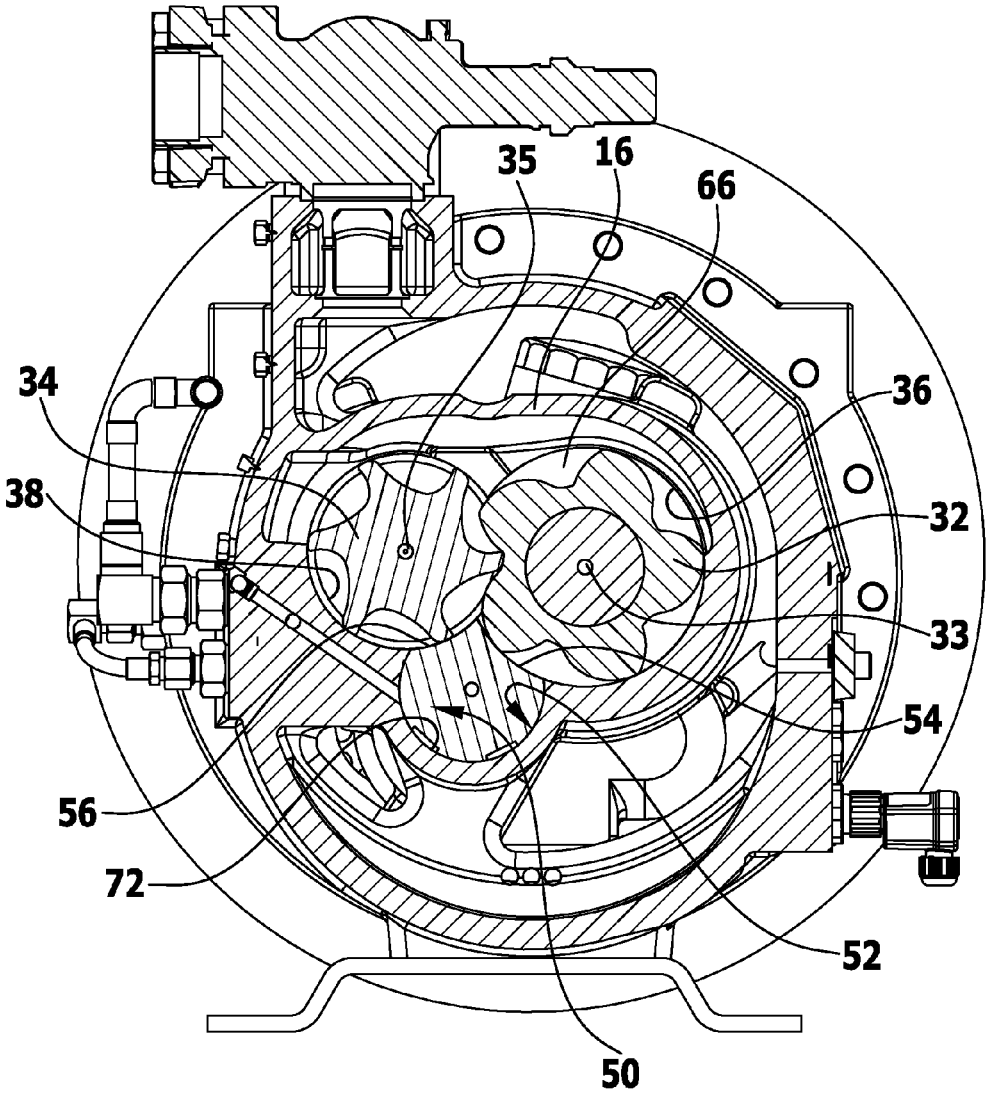
FIG. 5 is a section corresponding to FIG. 3, with the slider in the second position.
Figure 6:
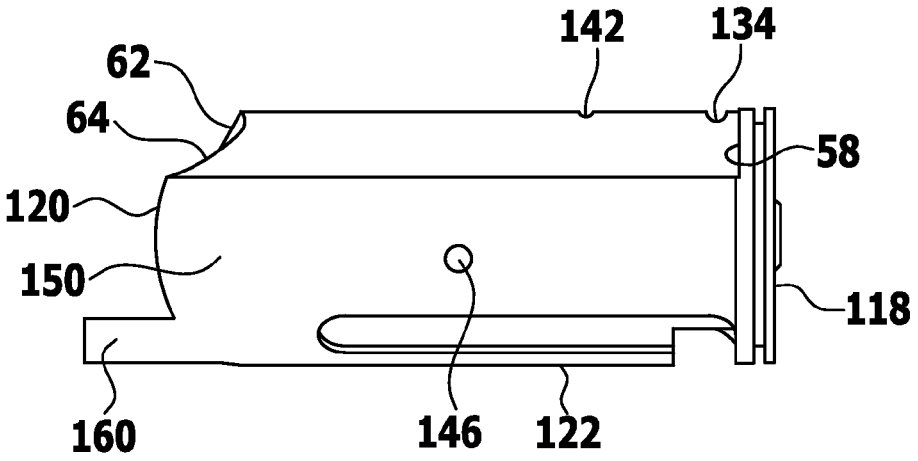
FIG. 6 is a side view of the slider of the first exemplary embodiment.

The slider 50 is movable to a first (FIGS. 1 and 3) and a second (FIGS. 4 and 5) position, wherein the first position corresponds to a high volume ratio, i.e. the volume of the first closed compression chamber relative to the volume of the last closed compression chamber results in a ratio that is higher than that at a low volume ratio which exists when, as shown in FIGS. 4 and 5, the slider 50 is in the second position, in which the discharge edges 62 and 64 are at a greater distance from the end wall 66 and therefore the medium being compressed that is trapped in the last compression chamber still closed is compressed to a greater volume than when in the first position so that the volume of the first closed compression chamber on the inlet side relative to the last closed compression chamber results in a lower ratio.

The slider receptacle 52 comprises a guide trough 72 which extends parallel to the screw rotors 32, 34 in the displacement direction 60 between an inlet-side end 46 of the screw rotors 32, 34 and an outlet-side end 48 of the screw rotors 32, 34 and comprises an insertion space 74 which adjoins the guide trough 72 and extends, via the inlet-side ends of the screw rotors 32, 34, following the guide trough 72, into the screw rotor housing 16 and beyond the inlet-side end 46 of the screw rotor bores 36, 38, and into which insertion space 74 the slider 50 extends to a greater extent, i.e. over a greater part thereof, when in the second position than when in the first position.

The insertion space 74 as part of the slider receptacle 52 is configured such that it is at least capable of receiving the cross-sectional shape and the extension in the displacement direction 60 of the slider 50 guided by the guide trough 72, in particular in the second position thereof, and a cross-sectional shape of the insertion space 74 corresponds to at least a cross-sectional shape of the slider 50 and for example guide surfaces 76 of the guide trough 72 merge into the insertion space 74 in a stepless manner.

For displacing the slider 50 between the first position, which is depicted in FIG. 1 and corresponds to a high volume ratio, and the second position, which is shown in FIG. 4 and corresponds to a low volume ratio, the slider 50 is provided, on the side thereof opposite the discharge edges 62, 64 and adjoining the end wall 58, with a piston body 80 which represents a first cylinder element and extends into a cylinder housing 82 which represents a second cylinder element and in which the piston body 80 is movable back and forth. Adjoining the guide trough 72, the cylinder housing 82 extends into the screw rotor housing 16, with the cylinder housing 82 in the first exemplary embodiment being directly integrally formed in the screw rotor housing 16 and being formed by the insertion space 74.

Figure 11:
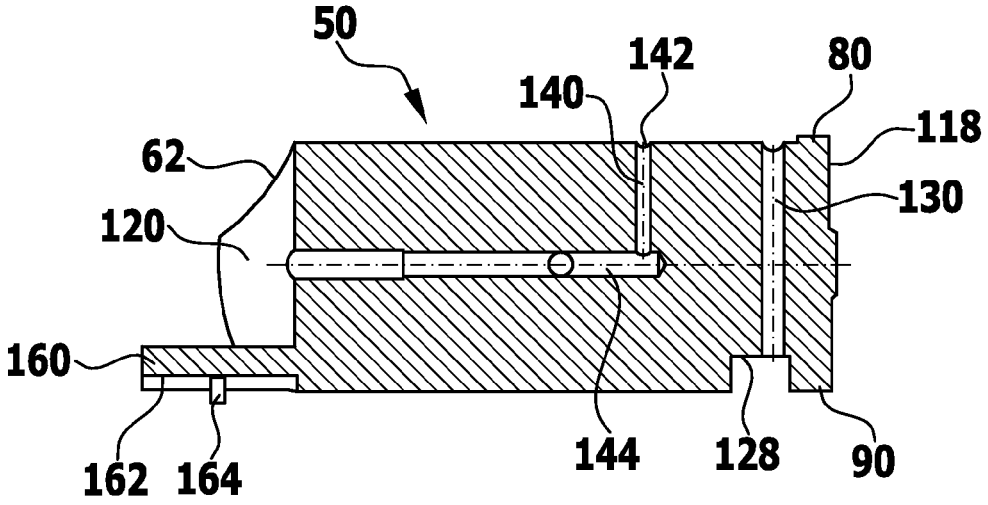
FIG. 11 is a section taken along the line 11-11 in FIG. 7.
Figure 7:
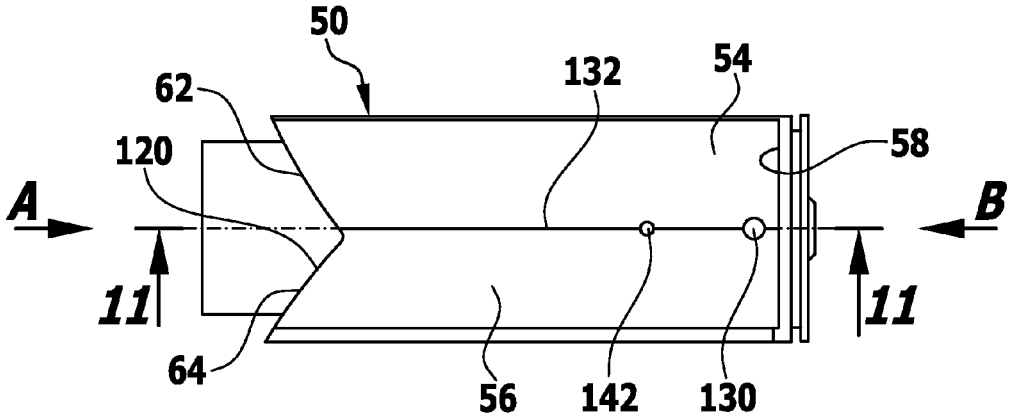
FIG. 7 is a plan view of the slider of the first exemplary embodiment.
Figure 8:
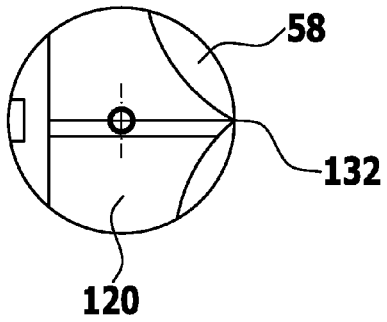
FIG. 8 is a view in the direction of arrow A in FIG. 7.
Figure 9:
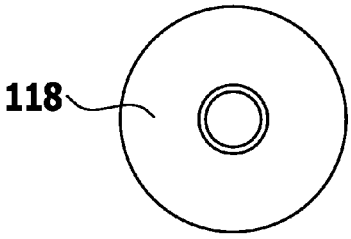
FIG. 9 is a view in the direction of arrow B in FIG. 7.
Figure 10:
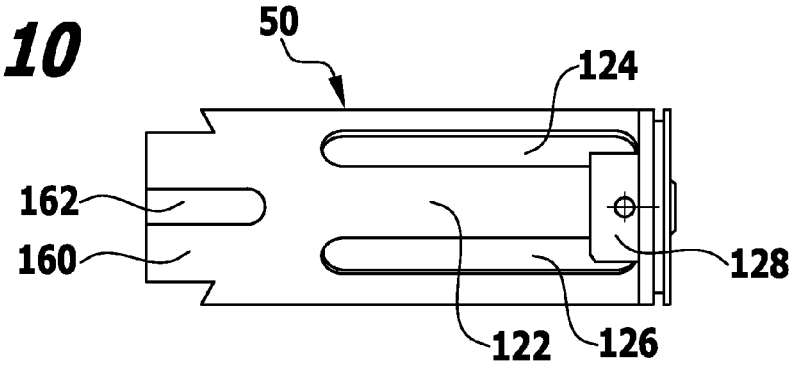
FIG. 10 is a view of the slider of the first exemplary embodiment as seen from below.
Figure 12:
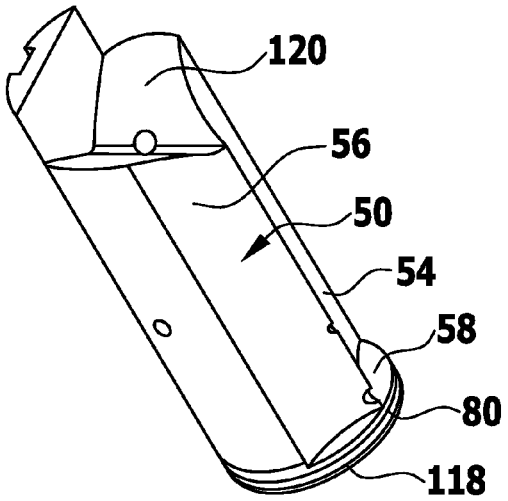
FIG. 12 is a perspective view of the slider of the first exemplary embodiment as seen from above.
Figure 13:
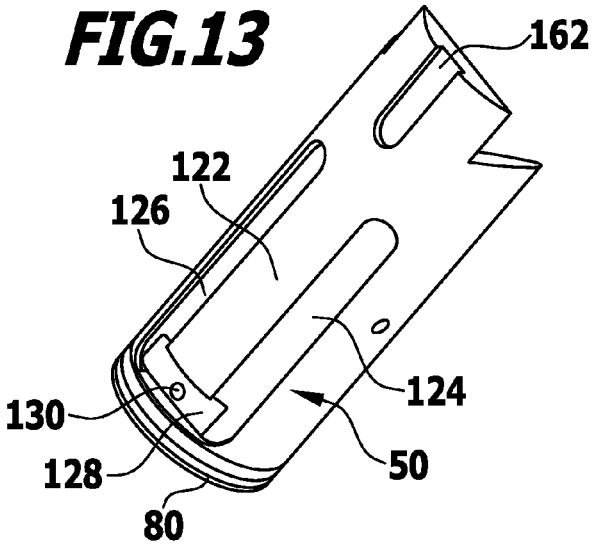
FIG. 13 is a perspective view of the slider of the first exemplary embodiment as seen from below.

Preferably, the cylinder housing 82 is configured such that it adjoins the guide trough 72 in a stepless manner, i.e. such that it has an inner cylindrical surface 84 which in terms of its central axis and its radius corresponds to an inner cylindrical surface 86 which at least partially forms the guide trough 72 and is sealingly contacted by a piston seal 90 of the piston body 80 (FIGS. 1, 4, 11).

The cylinder housing 82 has an extension in the displacement direction 60 of the slider 50 that is sufficiently large so that in the first position, which corresponds to a higher volume ratio, the piston body 80 is still within the cylinder housing 82 but at a maximum distance away from an end wall 88 of the cylinder housing 82.

It is preferred for the piston body 80 in said first position to be displaced in a direction of the high-pressure outlet 44 far enough that the end wall 58 of the slider 50 is at a small distance from an inlet-side end 46 of the screw rotors 32, 34.

By contrast, in the second position, which corresponds to a small volume ratio, the slider 50 is displaced sufficiently far so that the piston body 80 is near, preferably in contact with, the end wall 88.

The use of the piston body 80 integrally formed on the slider 50 and of the cylinder housing 82 immediately adjoining the guide trough 72 provides the possibility of accomplishing active controlled displacement of the slider 50 in the displacement direction 60 with only little space required in the screw rotor housing 16.

Now, in the solution in accordance with the invention, the slider 50 can be positioned in the first and the second position by providing for a control 100 (FIG. 1) which on the one hand determines the pressure ratio of the screw compressor via a sensor 102 that is associated with the low-pressure inlet 42 and is preferably arranged upstream of the low-pressure inlet 42, particularly between the latter and a suction-side shutoff valve 104 or even inside a suction conduit 105 leading to the suction-side shutoff valve 104, and via a sensor 106 which is associated with the high-pressure outlet 44 and is in particular arranged downstream of the high-pressure outlet 44, particularly still inside the high-pressure housing 18, to then move the slider 50 to the first position in accordance with FIG. 1 or the second position in accordance with FIG. 4, depending on the existing pressure ratio.

To this end, a supply conduit 112 to the cylinder housing 82 is capable of being connected, by way of a valve block 108, either with a high-pressure conduit 114 or a low-pressure conduit 116 so that either high pressure or low pressure exists in the cylinder volume ZV.

Where high pressure exists in the cylinder volume ZV of the cylinder housing 82, the slider is in the first position shown in FIG. 1, since the entire end face 118 of the piston body 80 has high pressure applied to it, this being counteracted by an end face 120 of the slider 50 which has high pressure applied thereto and by the end wall 58, which has low pressure applied thereto, wherein the areas of the end wall 58 and the end face 120 together give an area which corresponds, at most, to that of the end face 118 of the piston body 80 so that in sum the effective forces lead to a displacement of the slider 50 in the displacement direction 60 to the first position in accordance with FIG. 1.

However, with the cylinder housing 82 at low pressure, there is on the one hand a force acting in a direction towards the first position in accordance with FIG. 1 which results from the low pressure in the cylinder housing 82 and that of the end face 118, while forces act in a direction towards the second position which result from the action of the high pressure upon the end face 120 (FIGS. 1, 4, 6, 7, 8, 11, 12) and the action of the low pressure upon the end wall 58 and are therefore greater than the force generated by the cylinder elements 80, 82 so that in sum the slider 50 is displaced to and maintained in the second position.

The benefit of the solution in accordance with the invention is therefore that it allows the slider 50 to be moved to the first position or the second position in a simple manner, namely by merely connecting the cylinder volume ZV of the cylinder housing 82 to high pressure or low pressure.

In order to prevent the underside 122 of the slider 50, located opposite the end faces 54 and 56 thereof, from lifting off the slider receptacle 52, thereby urging the end faces 54 and 56 against the screw rotors 32 and 34, low-pressure pockets 124 and 126 (FIG. 6, 10, 13) are provided in the area of the underside 122 of the slider 50 and extend to a connecting pocket 128 which at least in the first position is itself connected, via an unloading channel 130 (FIG. 11) that extends through the entire slider 50, to the inlet-side ends 46 of the screw rotors 32, 34 and hence to the low-pressure inlet 42 and is thus always at low pressure.

Preferably, the unloading channel 130 terminates in a mouth opening 134 located in the area of a ridge 132 formed on the slider 50 by the end faces 54 and 56 thereof in adjacent relation to each other, said mouth opening 134 communicating with the low pressure in the area of the inlet-side ends 46 both when in the first and in the second position.

Figure 14:
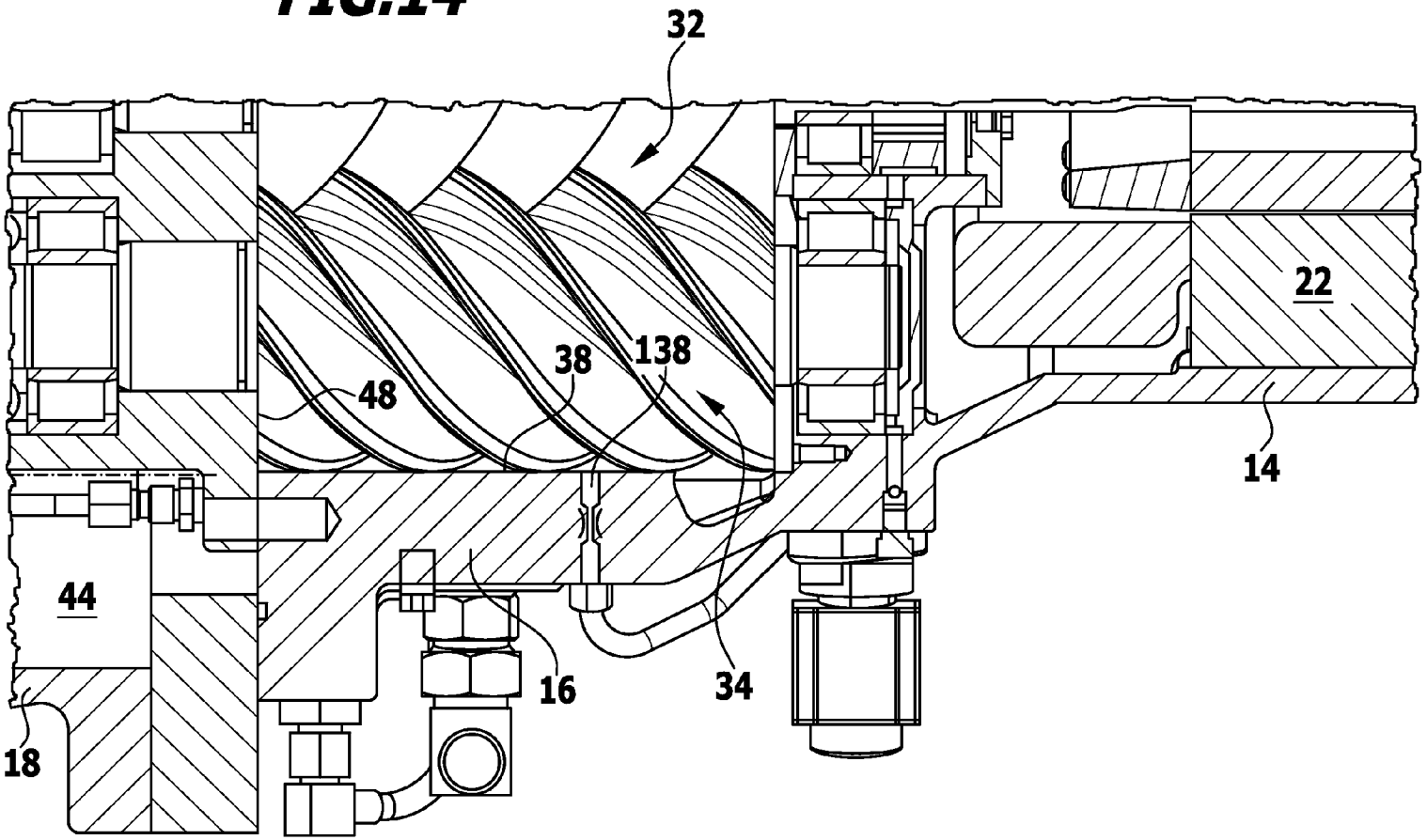
FIG. 14 is an enlarged view of Detail A in FIG. 2.

For cooling and lubricating the screw rotors 32 and 34 in the first and second positions, an injection channel 138 is provided, as illustrated in FIG. 14, which is used to inject lubricant into the first compression chamber forming between the screw rotors 32 and 34, in order to cool and lubricate the screw rotors 32, 34 and to seal the compression chambers forming therebetween.

Further, to be able to augment the cooling of the screw rotors 32 and 34 by the injection of lubricant in the first position of the slider 50, yet another injection channel 140 is provided in the slider (50), said injection channel 140 extending from an injection opening 142 at the ridge 132 into an interior space of the slider 50 and being connected, via connecting channels 144 running in the slider 50, to a supply opening 146 which is provided, outside of the end faces 54 and 56, on a guiding outer surface 150 of the slider 50 and aligns in at least the first position (FIG. 3) with a supply channel 148 provided in the screw rotor housing 16 but no longer aligns with said supply channel 148 in the second position (FIG. 5), since enhanced injection of lubricant is no longer required in that position.

By way of example, the amount of lubricant per unit time that is capable of being supplied via the injection opening 142 is at least twice the amount of lubricant per unit time that is capable of being supplied via the injection channel 138.

For anti-rotational fixing of the slider 50 in the slider receptacle 52, the slider 50 is additionally provided with a guide tongue 160 which is arranged on the underside 122 of the slider 50, preferably on a side opposite the discharge edges 62 and 64, and has a guide groove 162 that faces towards the slider receptacle 52 and in which engages a sliding block 164 held on the screw rotor housing 16, said sliding block 164 securing the slider 50 against rotation relative to the slider receptacle 52 and therefore guiding it in precise alignment.

Figure 15:
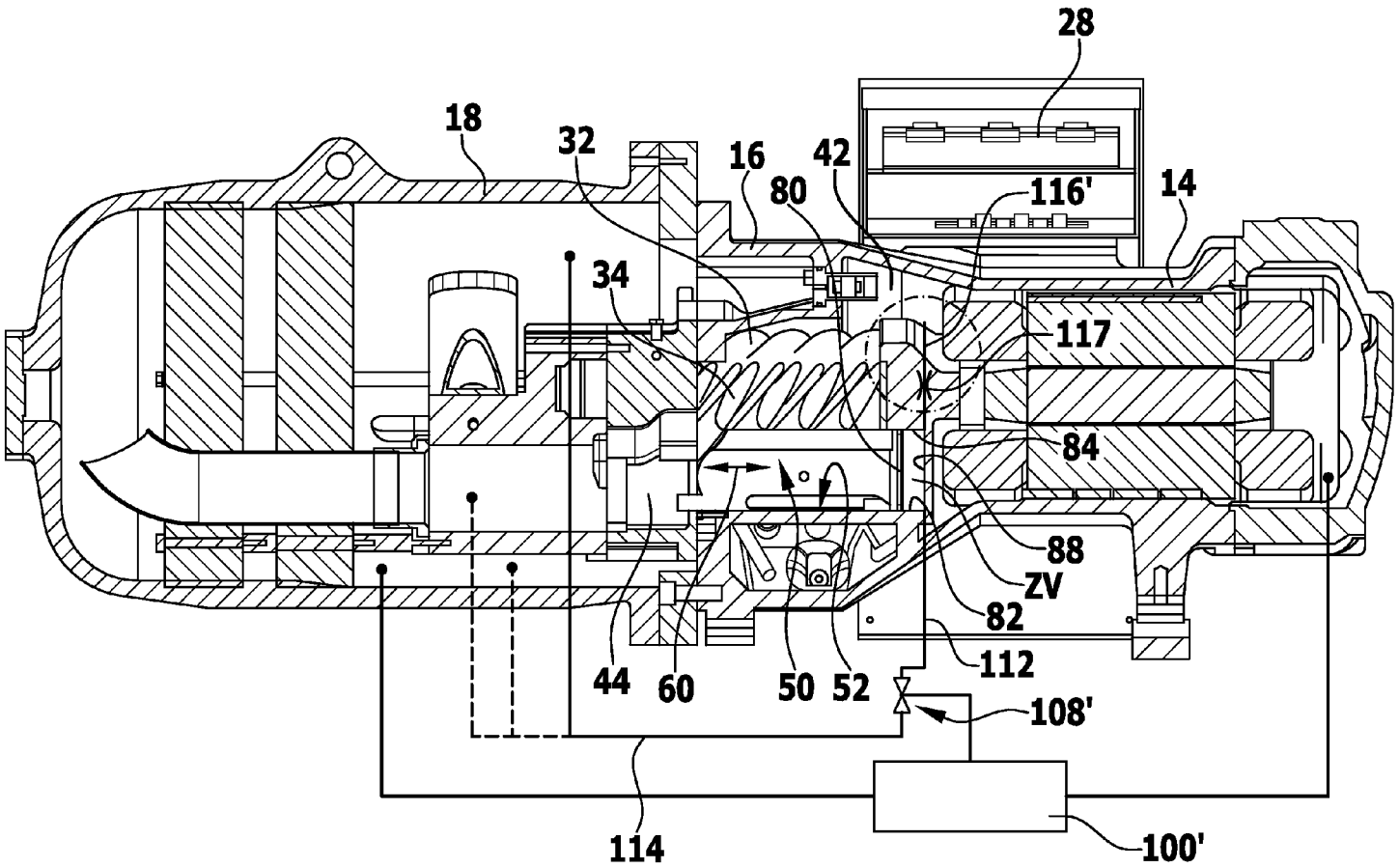
FIG. 15 is a partial section similar to FIG. 1, taken through a second exemplary embodiment using a slider control scheme that is modified as compared to that of the first exemplary embodiment.

An alternative possibility of controlling the slider 50 is implemented in a second exemplary embodiment, illustrated in FIG. 15.

In this exemplary embodiment, the low-pressure conduit 116' is provided with a throttle 117 between the cylinder volume ZV and the suction side, and it is not controlled.

It is only the connection between the supply conduit 112 to the cylinder space 82 and the high-pressure conduit 114 that is controlled by the control 100' via the valve block 108', wherein when the valve block is opened, the supply conduit 112 allows more refrigerant under high pressure to flow into the cylinder space 82 than can flow off via the low-pressure conduit 116' and the throttle 117 to the low-pressure inlet 42 so that ultimately high pressure builds up also in the cylinder space 82.

However, if the connection between the supply conduit 112 and the high-pressure conduit 114 is interrupted by the valve block 108', the pressure in the cylinder space 82 is relieved via the low-pressure conduit 116 and the throttle 117 so that ultimately the cylinder space 82 is at low pressure again.

Otherwise, the construction of the second exemplary embodiment in accordance with FIG. 15 is the same as that of the first exemplary embodiment; therefore, in respect of all other features, reference is made to the description of the first exemplary embodiment in its entirety.

Figure 16:
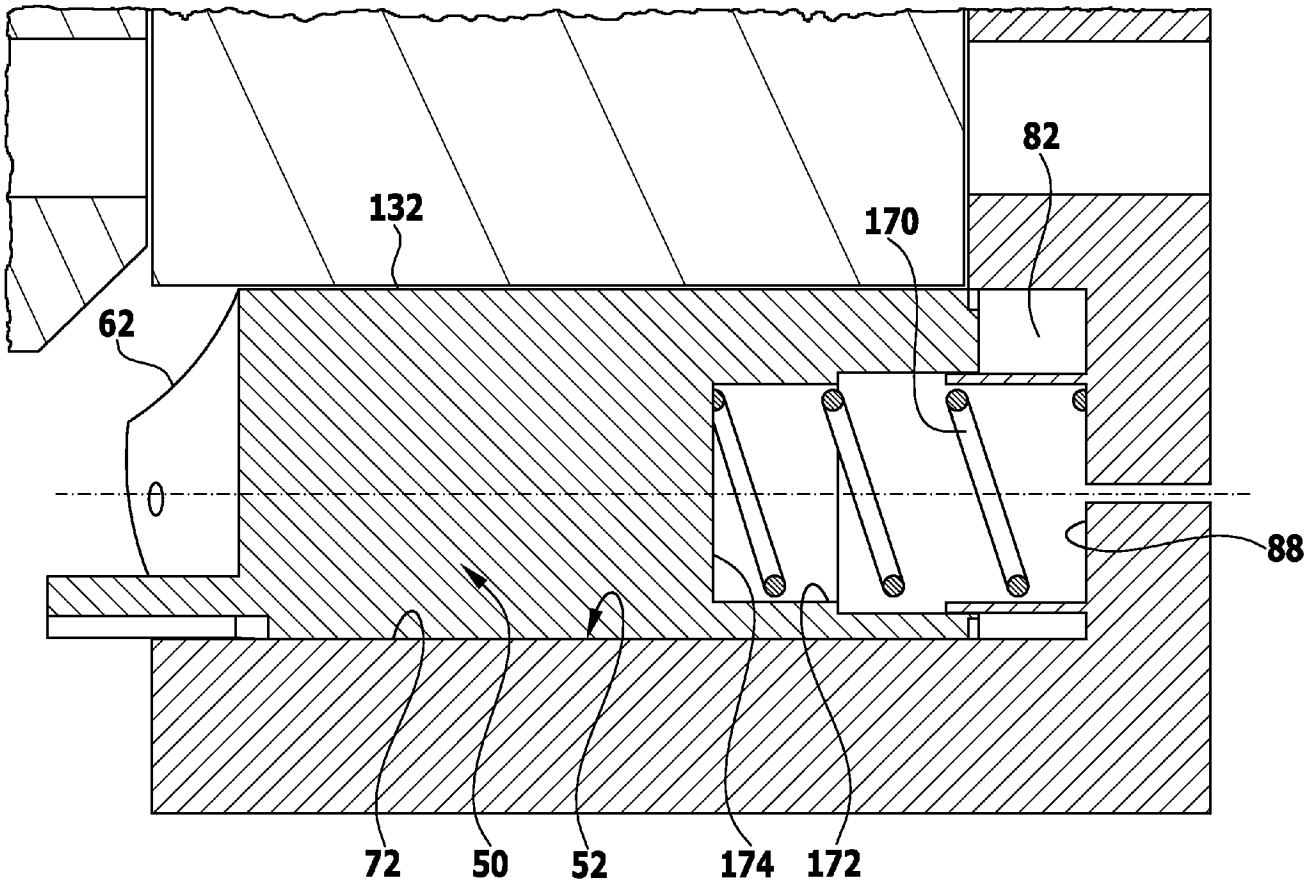
FIG. 16 is a partial section similar to FIG. 1, taken through a third exemplary embodiment in the first position.
Figure 17:
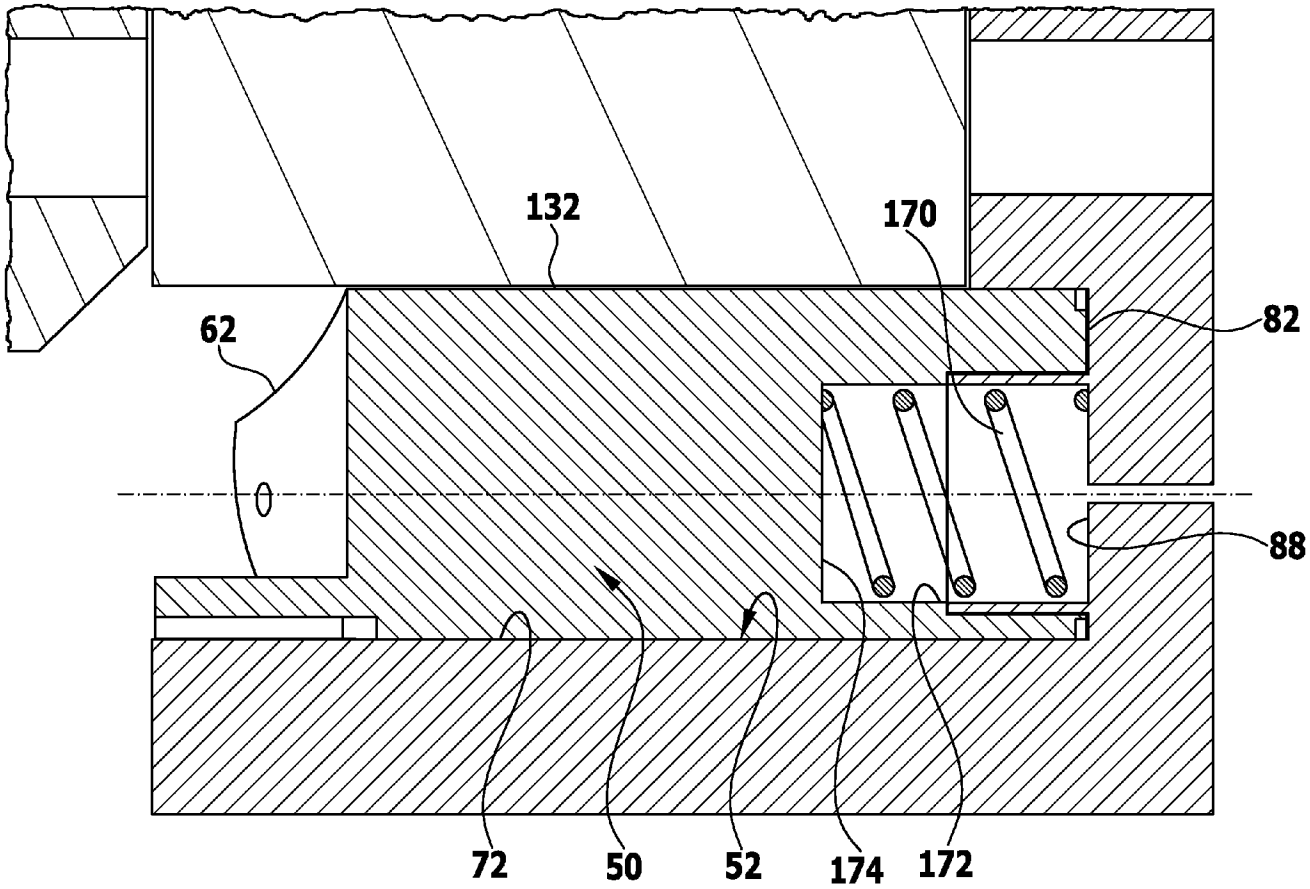
FIG. 17 is a partial section similar to FIG. 4, taken through the third exemplary embodiment in the second position.

In a third exemplary embodiment, illustrated in FIG. 16 and FIG. 17, the cylinder space 82 additionally has a compression spring 170 provided therein which rests against the end wall 88 and biases the slider 50 in a direction towards the second position, for example wherein the slider 50 is additionally provided with a receptacle 172 for the spring 170, serving to guide the spring 170.

The receptacle 172 extends for example into the slider 50 and comprises an end face 174 via which the spring 170 is supported on the slider 50.

The spring 170 provides an additional force in a direction towards the first position of the slider 50 which can also be utilized, for example in an unpressurized condition of the screw compressor, for initially urging the slider 50 to the first position during screw compressor start or during a screw compressor startup sequence and maintaining it in that first position at least during the startup sequence.

As is shown in FIGS. 16 and 17, with use of the spring 170 a force is generated by the pressure in the cylinder volume ZV and that of the face of the slider 50 which has said pressure applied thereto and which, as in the first exemplary embodiment, corresponds in particular to the end face 118, said force being generated in a direction towards the first position adding to the force of the spring 170, and these forces are opposed, as in the first exemplary embodiment, by the further forces acting upon the slider 50. In this case, however, the force of the spring 170 has to be dimensioned such that when the cylinder space 82 is at low pressure, the slider 50 is still held securely in its second position against the force exerted by the spring.

Figure 18:
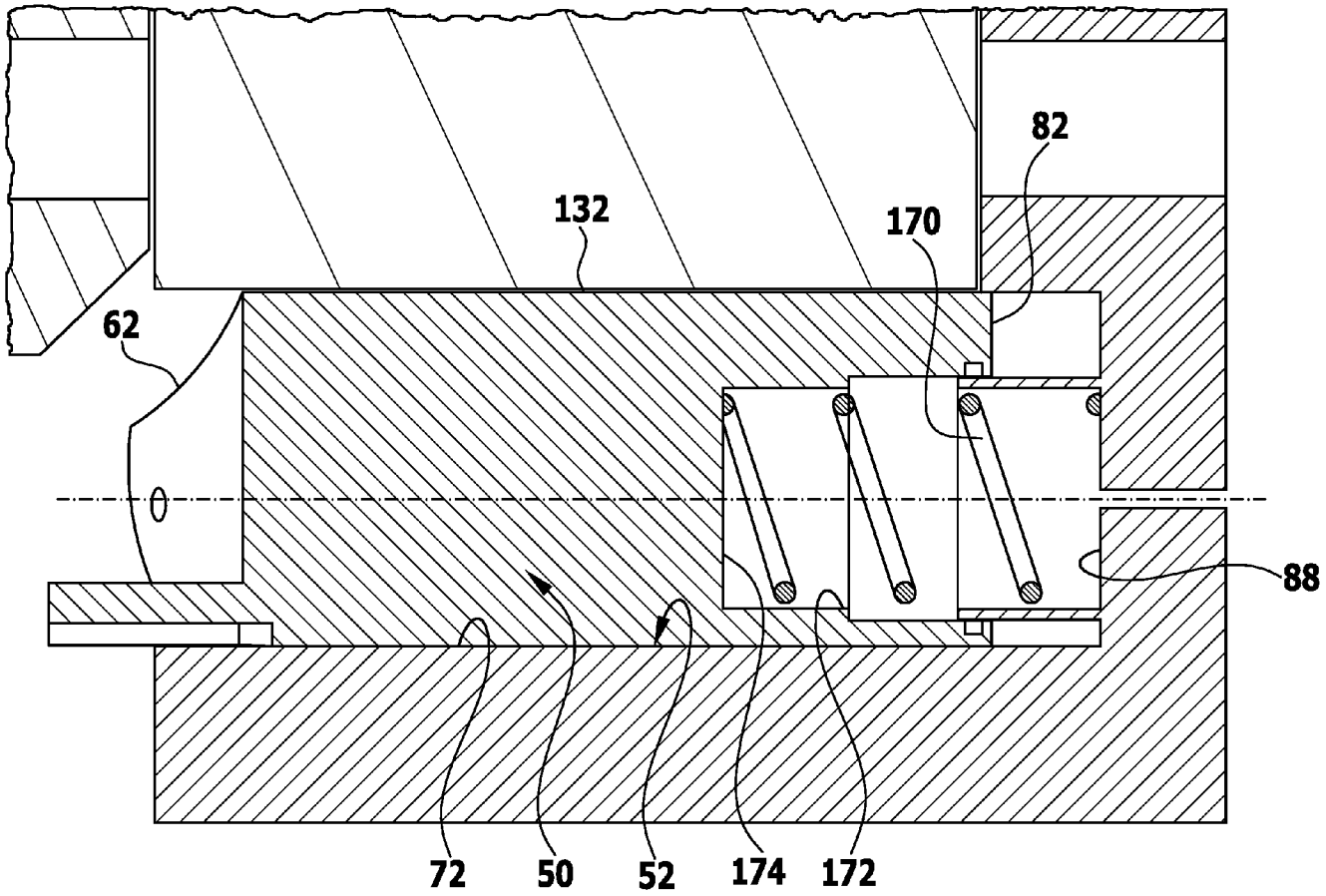
FIG. 18 is a section similar to FIG. 16, taken through a fourth exemplary embodiment in the first position.
Figure 19:
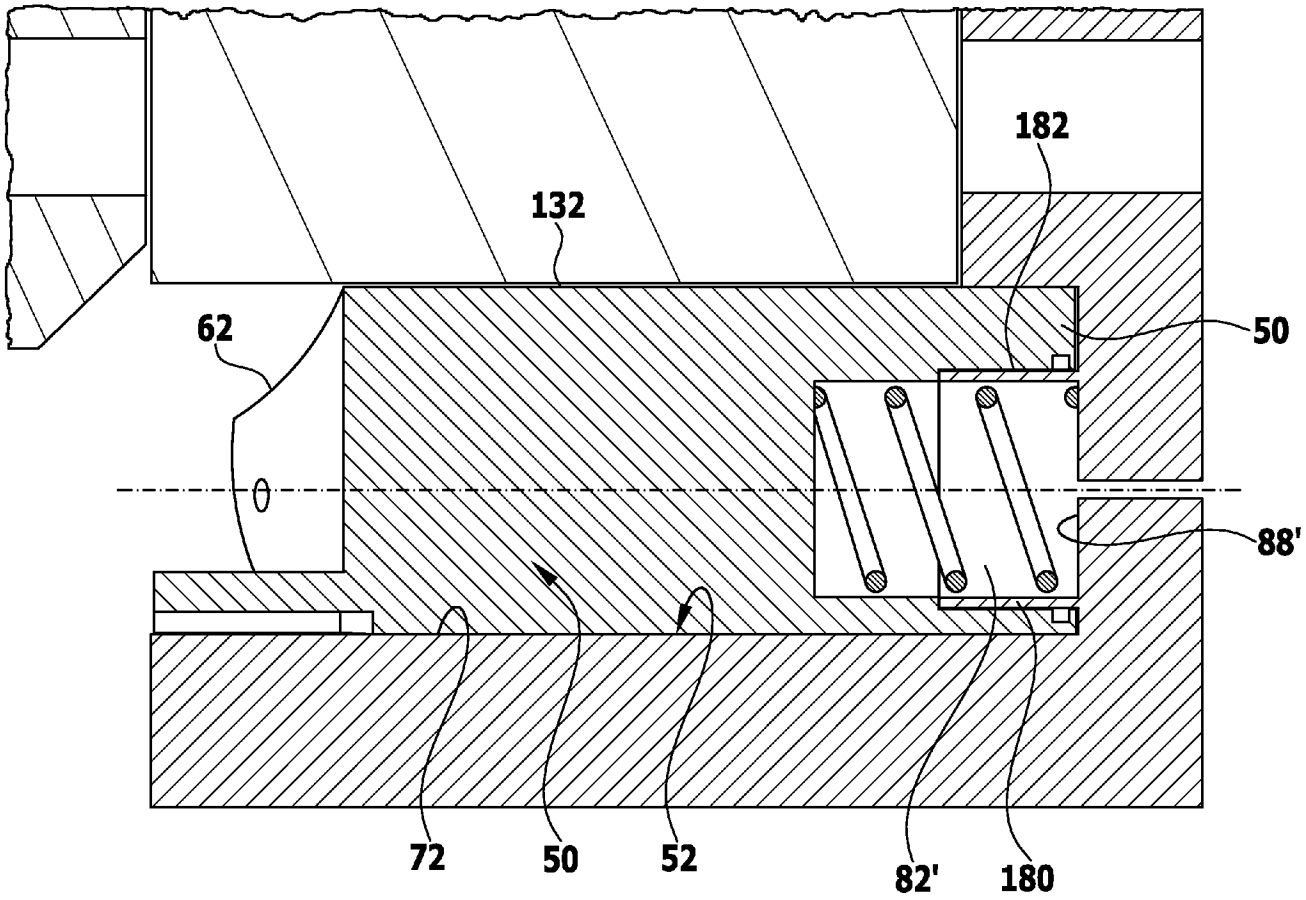
FIG. 19 is a section similar to FIG. 17, taken through the fourth exemplary embodiment in the second position.

In a fourth exemplary embodiment, illustrated in FIGS. 18 and 19, the cross-section of the second cylinder element 82 and therefore the area of the slider 50 that is capable of having applied thereto the pressure existing in the cylinder volume ZV is reduced by the end wall 88' having integrally formed thereon a sleeve 180 whose outer surface 182 provides for sealing between the first cylinder element 80' and the sleeve 180.

Otherwise, also in the case of the third and fourth exemplary embodiments, the features not explicitly mentioned in the description thereof are identical to those of the first and the second exemplary embodiment and reference can be made to the description of the first and the second exemplary embodiment in its entirety.

The invention claimed is:

1. Screw compressor comprising a screw compressor housing having a screw rotor housing, screw rotor bores arranged in the screw rotor housing, screw rotors arranged in the screw rotor bores and mounted in the screw rotor housing for rotation about rotational axes, a drive for the screw rotors, and a slider, which is guided for displacement in a slider receptacle in the screw rotor housing, and wherein the slider, in areas, in adjacent relation to the screw rotors has end faces extending toward discharge edges positioned along the screw rotors, for adjusting a volume ratio of the screw compressor and which the slider, starting from an insertion space of the slider receptacle, extends in a direction towards a high-pressure outlet in a guide trough of the slider receptacle that is open towards the screw rotor bores and which is movable between a first position and a second position, wherein the volume ratio of the screw compressor is greater in one of the positions than in the other of the positions, low-pressure pockets being provided on a side of the slider that is opposite the end faces thereof and is located in the guide trough, wherein the low-pressure pockets are maintained at low pressure via an unloading channel that leads to a low-pressure inlet.

2. The screw compressor as defined in claim 1, wherein the slider being connected to a first cylinder element which is at least partially arranged in the insertion space and cooperates with a second cylinder element which is at least partially arranged in the insertion space and the cylinder elements being arranged following the slider in the displacement direction thereof on a side of the slider that is opposite the high-pressure outlet.

3. The screw compressor as defined in claim 2, wherein the insertion space is configured for receiving the second cylinder element.

4. The screw compressor as defined in claim 2, wherein the insertion space has a cross-sectional contour that extends transversely to the displacement direction and is at least large enough to receive the slider and the first cylinder element.

5. The screw compressor as defined in claim 2, wherein the cross-sectional contour of the insertion space is adapted to the cross-sectional contour of the first cylinder element.

6. The screw compressor as defined in claim 2, wherein the first cylinder element is fixedly connected to the slider.

7. The screw compressor as defined in claim 6, wherein the first cylinder element is formed integrally in one piece on the slider.

8. The screw compressor as defined in claim 2, wherein the insertion space forms the second cylinder element.

9. The screw compressor as defined in claim 2, wherein the first cylinder element and the second cylinder element enclose a cylinder volume which has applied thereto either a medium compressed to high pressure or a medium at low pressure, in the form of a medium intended for compression.

10. The screw compressor as defined in claim 2, wherein the insertion space is configured for receiving the first cylinder element both in the first position and in the second position.

11. The screw compressor as defined in claim 1, wherein the insertion space is arranged free of overlap relative to the screw rotor bores.

12. The screw compressor as defined in claim 1, wherein the insertion space immediately adjoins the guide trough.

13. The screw compressor as defined in claim 1, wherein the insertion space is arranged laterally beside a low-pressure side bearing unit for the screw rotors in a radial direction relative to the rotational axes.

14. The screw compressor as defined in claim 1, wherein the insertion space extends in the screw rotor housing.

15. The screw compressor as defined in claim 1, wherein the insertion space has a wall surface portion which forms slider guide surfaces guiding the slider transversely to the displacement direction in the insertion space.

16. The screw compressor as defined in claim 1, the screw rotor housing having provided therein an injection channel by which lubricant is suppliable to the screw rotors, in to the form of a compression chamber formed thereby.

17. The screw compressor as defined in claim 1, the slider being provided with an injection opening for lubricant that faces towards the screw rotors.

18. The screw compressor as defined in claim 17, wherein the injection opening is in communication with an injection channel which is suppliable with lubricant from the screw rotor housing via a supply opening.

19. The screw compressor as defined in claim 18, wherein the amount of lubricant injected via the injection opening in the slider is at least the same amount of lubricant that is injected via the injection channel.

20. The screw compressor as defined in claim 1, wherein the drive is a variable speed drive.

21. The screw compressor of claim 1, wherein the discharge edges adjust the volume of the screw compressor during movement of the slider.

22. Screw compressor comprising a screw compressor housing having a screw rotor housing, screw rotor bores arranged in the screw rotor housing, screw rotors arranged in the screw rotor bores and mounted in the screw rotor housing for rotation about rotational axes, a drive for the screw rotors, and a slider, which is guided for displacement in a slider receptacle in the screw rotor housing, the slider receptacle comprising a guide trough which extends parallel to the screw rotors between an inlet side end of the screw rotors and an outlet side end of the screw rotors and comprises an insertion space which adjoins the guide trough and extends beyond the inlet side end of the screw rotors into the screw rotor housing and wherein the slider in areas, in adjacent relation to the screw rotors has end faces extending toward discharge edges positioned along the screw rotors, for adjusting a volume ratio of the screw compressor and which the slider, starting from the insertion space of the slider receptacle, extends in a direction towards a high-pressure outlet in the guide trough of the slider receptacle that is open towards the screw rotor bores and which slider is movable between a first position and a second position, wherein the volume ratio of the screw compressor is greater in one of the positions than in the other of the positions, low-pressure pockets being provided on a side of the slider that is opposite the end faces thereof and is located in the guide trough, wherein the low-pressure pockets are maintained at low pressure via an unloading channel that leads to a low-pressure inlet.

23. The screw compressor of claim 22, wherein the discharge edges adjust the volume of the screw compressor during movement of the slider.

* * * * *